US006702692B1

(12) United States Patent
Smith

(10) Patent No.: US 6,702,692 B1
(45) Date of Patent: Mar. 9, 2004

(54) PRECISE FIT GOLF CLUB FITTING SYSTEM AND GOLF SHAFT SELECTION METHOD AND APPARATUS

(76) Inventor: Earl F. Smith, 401 Elizabeth Lake Dr., Hampton, VA (US) 23669

( * ) Notice: Subject to any disclaimer, the term of this patent is extended or adjusted under 35 U.S.C. 154(b) by 0 days.

(21) Appl. No.: 09/204,301

(22) Filed: Dec. 3, 1998

Related U.S. Application Data

(63) Continuation-in-part of application No. 08/863,893, filed on May 28, 1997.

(60) Provisional application No. 60/067,355, filed on Dec. 3, 1997, and provisional application No. 60/018,574, filed on May 29, 1996.

(51) Int. Cl.[7] ..... A63B 53/10

(52) U.S. Cl. ..... 473/289; 473/409

(58) Field of Search ..... 473/409, 407, 473/289; 73/1.75, 1.37; 29/407.1

(56) References Cited

U.S. PATENT DOCUMENTS

| | | | | | |
|---|---|---|---|---|---|
| 4,163,941 | A | * | 8/1979 | Linn | 473/409 |
| 5,249,967 | A | * | 10/1993 | O'Leary | 473/409 |
| 5,486,001 | A | * | 1/1996 | Baker | 473/409 |
| 5,797,805 | A | * | 8/1998 | Lubell | 473/409 |
| 5,879,246 | A | * | 3/1999 | Gebhardt | 473/409 |
| 5,911,636 | A | * | 6/1999 | Schmoll | 473/409 |

* cited by examiner

*Primary Examiner*—Stephen Blau
(74) *Attorney, Agent, or Firm*—Paul V. Del Giudice

(57) ABSTRACT

A computer software controlled method of fitting a golf shaft to a golfer having steps of electronically determining the selection of a shaft by electronically testing, recording and storing a golfers reliable club head swing speeds values and face angle/degrees at impact. Testing to determine flex choice based on face angle/degrees at impact is completed first and then testing to determine stiffness based on head speed is completed second.

4 Claims, No Drawings

PRECISE FIT GOLF CLUB FITTING SYSTEM AND GOLF SHAFT SELECTION METHOD AND APPARATUS

This application is a continuation-in-part application of my prior U.S. Ser. No. 08/863,893 and International Application No. PCT/US97/09451, filed May 28, 1997 by Earl F. Smith entitled "Precise Fit Golf Club Fitting System and Golf Shaft Selection Method and Apparatus", and claims the benefit of Provisional applications No. 60/067,355, filed Dec. 3, 1997 and No. 60/018,574, filed May. 28, 1997, which is incorporated herein by reference.

BACKGROUND OF INVENTION

The invention relates to new data obtained. With my invention process it is now possible to record and track specific shaft reactions associated to individuals swings. The golfers/players fitting characteristics or needs should be addressed individually. To help define the swing characteristics of individual golfers, it is therefore necessary to expand on the original application, "Precise Fit Golf Club Fitting System and Golf Shaft Selection Method and Apparatus", identified above.

Established reliable speed standards for club selection in the prior application to begin the testing through statistical data obtained, are verifiable. For example, the 86-mph boundary outlined to continue testing in the R flex after reliable speeds have been established, has proven through my inventive process to be accurate. After acceptable reliable speed ranges have been established and the appropriate shaft is chosen, the testing continues. I have further established that while golfers/players can hit a golf ball in some degree with any shaft stiffness (flex), reliable speeds that register under 86-mph when using the R flex will result in loss of overall distance. The guidelines established by my inventive process indicate that reliable speed ranges are accurate for testing of an individual. However, specific flexes (stiffnesses) of shafts, as they exist by current or prior art, have no defined correlation with reliable club head speeds in the final determination. Golfers/players with identical club head speeds sometimes need or require different shaft stiffnesses. All golfers/players are not alike and have specific and individual characteristics that are priorities or properties of their own individual swing, and only by testing individually can a proper determination of shaft selection of stiffness and flex choice values be defined for better play. It is my conclusion that shafts as currently exist on the market by prior or current art, in steel or composite/graphite, may or may not conform to this guideline. Depending on individual manufacturers'specifications, the parameters may be changed, but the overall ability of my inventive process to measure the function of a shaft does not. The relationship of angles/degrees and clubhead speeds does not change from that disclosed in my prior application. Absolute standards in technical terms in today's golf industry, regarding shafts of steel or composite/graphite and regarding stiffness is at the discretion of the manufacturer and/or their finished products. Existing standards relate to the way shafts have been marketed currently or prior. A manufacturer could simply change the stiffness (flex) factors, torque factors and call it the same product, but not inform the public of such changes, which I know has happened or occurred. One may surmise that "it" functioned as a golf shaft in the market, so it is what they say it is. This means the public trusts the golf industry with their definition and marketing of golf shafts, but the truth is such may not be true, particularly to composite/graphite shafts and some steel shafts.

Quote: "The letter's X, R, S and L are commonly employed in the golf club art to denote shaft stiffness characteristics. X stands for extra stiff, S for stiff, R for regular and L for ladies. These terms are relative and have no commonly accepted absolute definition agreed upon to cover all types of shafts" as described in detail in U.S. Pat. No. 4,169,595. I have concluded this is an accurate statement. While the golf industry still offers low, mid and high flex points (flex choices) in shafts, the history of the golf industry has centered on the flex (stiffness) values.

Until my patent pending process enabled accurate measurement of each golf shaft as it relates to an individual player, the golf industry could only repeat their past misconceptions. Until flex stiffness, as marketed by the industry, becomes secondary to the flex point or kick points, confusion in the publics mind will continue. For that reason I may choose to refer to kick or flex points as "Predetermined Defined Give Points" or PDGs. With my inventive process a change is now possible to set standards for shafts through further research and discovery. A new series of shafts with the consistency of steel and the lightwightness of composite/graphite may now be perfected, which is the subject of another U.S. application of mine. Existing shafts may be re-engineered with flex or kick points being the prime objectives for standardization in the market and not flex stiffnesses, as have previously existed, now and for the future. One could argue these standards exist in the industry today regarding shafts, but improvements to shafts as exist by prior or current art must evolve. It has been my experience when testing composite/graphite shafts that differences can occur in the performance of one order or shipment of shafts received to the next. In order for the new shafts received and installed in the demo clubs to test and register the same readings with my inventive process as before, separate testing with the new and the old demos are made and compared to detect any differences in performance. Repeated testing with individual golfers/players with those specific composite/graphite shafts, for verification shaft reaction and performance, occurs. Shafts with the same distinguishing marks, logos, stiffness, and torque values may not be the same product as previously received. For improvement, a new series of shafts designed around playability, according to my inventive process, is needed and should be developed and perfected in the future which is the subject of another U.S. application of mine. Some steel shafts being offered in new clubs for 1998 were offered in the same basic form in most major brands in 1950, 1954 and 1957, to name a few. Thus, they are not new shafts, but old shafts sold at a new time.

Torque: rotating or twisting of a golf shaft. It should be pointed out that information available to the ultimate consumer in terms of torque values are mixed, regarding the specifications of golf shafts, either steel or composite/graphite. With few exceptions, the steel shaft manufacturers do not specify any torque value in their printed material. However, on the other side, composite/graphite torque values are indicated visibly in most instances in all printed material as regards marketing the shaft product. If torque values of steel shafts are not readily published along with the torque values indicated by composite/graphite shafts, one may ask why? It should be noted that titanium shafts in the printed material I have observed, list the torque values as it relates to their specific product. I would conclude this as marketing strategy toward the public. It has been and now is not known that consistency between steel and composite/graphite shafts does or does not correspond with any uniformity. There are times when composite/graphite shafts have advantages over steel shafts in their present form; "special needs" is an example. There are no bad shafts, only wrong shafts in individual clubs or sets of clubs.

It does not matter if the torque is unknown to the testing operator or golfer/player. My inventive process can still select a shaft that is best suited for the player/golfer at that time. Even though torque values of steel shafts have not been made readily available or known by the public, it is not absolutely necessary to know torque values to select a shaft that works by my inventive process. If the torque values, as established by the manufacturers of composite/graphite shafts were consistent from shaft to shaft, they would be of value from a golfer/player standpoint in some applications. I have found that the influence of different torque values can affect the overall performance of a shaft. Different torque values offered in shafts have been claimed by individual manufacturers to be reliable. Thus, one must rely on the torque values supplied and identified by the manufacturers to be accurate. The question arises that if the stiffness flex is R and composite/graphite shafts can be engineered differently with other exotic materials, would the same designated stiffness values and the same torque value s (i.e., 4.0 degrees), react or perform the same? The answer is no! Composite/graphite shafts offer much more of a challenge in testing than with steel, because of the consistency affiliated with steel, which does not exist in composite shafts which lack consistency. It is my determination, through statistical data collected, that torque can influence, in either a negative or a positive way, golfers/players abilities and choices. Through further discovery I hope to clarify and verify this statement.

I have also discovered and confirmed through testing that both the flex choice value and the stiffness value of a golf shaft also affects swing path at impact, as well as angle/degrees, open or closed, at impact.

It appears at this time that the individual player swinging the golf club with his or her particular characteristics inherent to each golfer/player, will influence the selection process. My prime objective is to insure the maximum accuracy and distance as it relates to an individual golfer/player. Since the filing of my provisional application No. 60/0181,574, continued testing with various individuals of different skill levels appears to indicate that shaft flex (stiffness) becomes secondary to the flex, kick points (PDG) (flex choices) being tested and/or selected. If higher speeds are opted for over finite accuracy, choices based on higher reliable speeds also are possible. Depending on the type of play the golfer/player enjoys, he or she may opt for distance over finite accuracy. As long as the angle/degrees/parameter (zero to eight degrees), as close to zero at impact is followed, the higher speeds could be selected. The accuracy will not be as finite, but be well within the acceptable factors of 0–8 degrees. It is possible to do the same with other angle/degrees parameters/angles of 0–11 degrees and 0–15 degrees. Golfers/players tested over 15 degrees will create more problems with their golf swing than will be solved. Learning the fundamentals of the game are more valuable.

Until testing is complete, the flex point (PDG) (flex choice) and stiffness (flex) have not been determined.; While the industry gives value to different torque values, the torque values are subject to interpretation.

Through my inventive process, I have determined that woods and irons need to be tested separately. I have found and confirmed that reliable club head speeds established for irons (See Exhibit One) through testing and recording are lower than reliable club head speeds recorded through testing and recording for woods most of the time (See Exhibit Three). See pages 19–22 hereinafter for these Exhibits and examples. The length of the shaft especially in woods, when combined with the golfers/players particular swing characteristics and overall proficiency, can sometimes affect the accuracy of the recorded information gathered while testing. There can be instances at any level of play, when testing a golfer/player that the reliable speeds recorded between irons and woods can be reversed. This is usually created by a swing fault. Under the category of "Special Needs", this condition is not usual if a physical handicap is involved (See Exhibit Two). Treat the wood and iron testing procedures as separate fittings for best results. Both woods and irons should be tested at the same time to insure continuity and complete the process, although separate time testing of woods and irons is acceptable. To endow the golfer/player with better skills to more enjoy the game of golf, the operator/instructor can now equip the player with the proper shaft to enhance performance and to insure success. The operator/instructor, or the golfer/player, may at their option choose, to test each iron or wood separately. This is possible through my inventive process and at selected times could be beneficial to the individual being tested. Until quality controlled uniformity standards are adopted and practiced throughout the industry, differences in shaft marketed characteristics can and will occur. With my inventive process, I have found that golfer/players are best fitted in a specific flex (PDG) choice and in a more flexible shaft choice, than current trends being touted by the golf industry, which appears to lean towards stiffer shafts. In addition to the L, R, S and X flexes previously recognized by the golf industry, a "senior flex" or A flex (stiffness) in three or four basic flex point choices is offered. I would conclude that the introduction of other shafts like the "senior flex" make it apparent that the golf industry recognizes such problems exist in the industry. The term "senior flex" I find is a misnomer since this shaft flex is suited to golfers other than those of senior ages.

Data obtained while testing will reveal tendencies that are priorities of an individual. Golfers/players with slower overall clubhead speeds tend to swing more with their large muscles (legs and/or hips) and will record similar club head speeds and angles/degrees at impact when tested with shafts having different flexes and PDG's. Hand and/or arm swingers when tested with different shafts tend to display a more diverse pattern of angle/degrees values, open or closed, at impact. While both are acceptable by current teaching methods, the differences can alter the outcome of the testing. Thus, all golfers/players are individualistic. I have also found that in many instances, leg and/or hip swingers tend to have a more "outside-in" swing path at impact.

A player may desire to want to element of "feel" in their personal game. Feel could be defined as what a golfer/player has been educated to believe and experience through the golf industry as being important, but it is intangible. The stiffness (flex) of a golf shaft can affect distance and acuracy when too stiff. With my inventive process, stiffness (flex) can affect accuracy and distance in a positive way because of its ability in matching golfers/player abilities with the proper shaft selection. Shaft stiffness parameters, as defined by my inventive process, will begin the initial testing based on speeds; however, a particular shaft in a specific stiffness used for testing may or may not be relative to the final selection of the process. The stiffness (flexes) of shafts as currently marketed is a relative term, as it relates to prior or current golf equipment sold on the market.

In the past, the accepted formula for golf equipment has been "mass plus velocity equals distance". If "mass plus velocity" equates golf in this statement, what is distance? My inventive process makes it possible to define distance as "actual direction" or "keeping it in play". Distance, without acceptable accurate direction, in golf, is meaningless. Boundaries and hitting areas define the success of play, not distance alone. It is estimated 50 million people around the world play golf and more than 90 percent, according to the United States Golf Association (USGA), cannot break the score of 100. According to USGA statistics, golf handicaps have not changed in 30 years, claims of new improvements made by the major equipment companies are now being questioned; the USGA, is asking why? The "high tech" explosion promised in the 80's, is past. A recent survey that spans the last 20 years reports that golf handicaps of golfers that have played over five years have risen 2 strokes from 17 to 19. The overall stroke average on the PGA Tour has not changed in 25 years, according to the USGA, and the USGA is finally asking, "what is going on"? With my inventive process the formula can be changed to "mass plus velocity equals accuracy, direction and distance".

Golfers/players often us the term "proper flight" in their golf vocabulary to describe their perception of how the ball or shot should react in flight according to their interpretation. When the proper golf shaft is selected through my inventive process, "proper flight" may be interpreted as, or considered to be, the particular or proper flight for that individual golfer/player.

Some manufacturers have determined that "proper lie" is the basis for their "custom club" fitting process. Proper lie is currently defined by the market as the clubhead at address "sitting squarely on the ground at address". What that defines, I'm not sure. It has been my experience, through my inventive process, that the proper lie, as defined and marketed by the golf industry, comes under scrutiny. The proficiency of the player, at the moment of impact with the ball will determine the "proper lie" as it regards direction. Swing tendencies will dictate "proper lie" and not the "sitting squarely on the ground at address" as touted by the golf industry. The better the player the more "squarely" the bottom of the clubhead is at impact, and the player of lesser ability may need the toe slightly off the ground, or upright at impact, to assist with direction. If the toe of the club strikes the ground at impact, adjustments should be made for better results. It may be necessary to apply tape on the face of the club, thus an imprint of the ball could be documented for verification at impact.

Loft changes, are at the whim of the manufacturers; depending on the model, it is subjective. Standards that once were thought of as the norm, are no longer adhered to.

In an effort to position their products in the marketplace more advantageously, some manufacturers have changed the lofts to insure more distance. Although this is not illegal, it can cause much confusion in the mind of the consumer. This way the golfer/player will assume they have a superior product to play with. In past years, pitching wedges were marketed at 52 degrees loft. Changes in marketing strategy, along with the changes in golf shafts, offered new lofts in pitching wedges of 44 and 48 degrees, as an example. Many manufacturers market their equipment with the same basic shafts, this trend through advertising tends to insure success. Brand loyalty can determine the success or failure of a company.

Shafts which are considered to be "the engine that drives the golf club" have gone through changes too. Taper tip steel shafts were the cornerstone of the golf industry at one time. Some manufacturers used from 3 to 8 shafts per iron set in a specific stiffness to construct a set of clubs. To construct one set in R flex and one set in S flex could require a total of up to or 16 individual shafts, or a combination thereof. This made inventory very tedious and costly. The "combination" steel shaft entered the market and simplified the process. With one "combination" R/S shaft, the manufacturer could replace up to 16 shafts, or a combination thereof, to just one shaft to construct the R Flex and the S Flex set of irons. By combining the new senior A flex with the ladies or L flex into an A/L flex, another combination shaft was created. Two "combination shafts", A/L and R/S replaced the existing inventory and inventory was much more manageable for the golf industry manufacturers. I would conclude that the merging of two shafts into one combination shaft of either A/L or R/S has resulted in an overall loss of distance, and stronger lofts have been required to satisfy the market. Did the manufacturers serve their needs or create needs on behalf of the public?! The latter appears to be true. "Combination" shafts do not enhance playability for most golfers.

My inventive process will allow testing to be conducted with any type of golf ball the operator/instructor chooses. If the testing is done in a confined area, safety should be a prime consideration. An important aspect of my invention is that visual testing is not important or mandatory.

OBJECTS OF INVENTION

I. It is the primary objective of my invention to enhance the conclusions of my first process.

II. Determining that the flex point, flex choice of a golf shaft is a primary objective of shaft selection, and that the stiffness value is a secondary consideration to flex choice selection.

Other objects and advantages will be apparent to those of ordinary skill in the art upon reading this disclosure.

DETAILED DESCRIPTION OF THE INVENTION

The invention relates to new data obtained after the filing of my above-referenced U.S. application. With my inventive process it is now possible to record and track specific shaft reactions and swing characteristics of individual golfers. It is therefore necessary to expand on my original application, "Precise Fit Golf Club Fitting System and Golf Shaft Sections Method and Apparatus", referenced above.

Initially, in order to determine if the golfer has the correct golf shaft for his or her golf swing, it is necessary to first test the golf equipment they are currently playing, if available. The shot/swing analyzer currently used is the Miya Computer Shot Analyzer which records clubhead speeds, angles/degrees, distance, deflection and swing path in multiple display functions. A comparable unit (current or future) could be used for the testing. Each individual reliable swing speed and swing characteristic will be recorded separately to afford comparison thereof to other recorded reliable swing speeds and the test parameters of the shaft selection process. If the golfers current equipment is not available, a demo club in steel, which in the first application was the R stiffness as established by prior or current art, begins the testing, if the golfers/players recorded reliable speeds, i.e., (4) four times, record under 86-mph, the L or A stiffness (flex) shaft can be used to continue the testing. If the reliable club head speeds are 86-mph or higher, use the R stiffness (flex) shaft to continue or begin the testing. The testing provides a cross check of the selection process to insure success with the selected shaft. I must state herein that the Miya Shot Analyzer was never intended by its manufacturer to be used for shaft selection or "club-fitting" and was only sold as a training or practice device. I alone discovered that this Miya device became an enabling component of my inventive methods and system.

In U.S. Pat. No. 4,169,595, as regards shafts, it is described in detail as, "In practice I have found that the above deflection readings for the UCV-304 TM are meaningful to golfers in that the flex labels X, S, R and L applied to shafts give a good indication of how the shaft will play in terms of stiffness when compared with well known previously existing shafts, such as Propel II TM". (Emphasis added).

U.S. Pat. No. 4,169,595 further states, "The letters X, R, S and L are commonly employed in the golf club art to denote shaft stiffness characteristics. X stands for extra stiff, S for stiff, R for regular and L for ladies. These terms are relative and have no commonly accepted absolute definition". Determination of the X, R, S and L flexes in connection with the shafts of the invention is as described in detail in U.S. Pat. No. 4,169,595. (Emphasis added).

If "The terms X, R, S or L flexes are relative and have no commonly absolute definition", and if the above patent also claims, "In practice I have found etc.", then it becomes subjective. These two statements of application and definition conflict. One would argue, that the flex labels X, S, R and L applied to shafts as claimed, do not give a good indication of how the shaft will play in terms of stiffness, but they are only meaningful for the duplication of manufacturing and marketing of a golf shaft as it pertains to an industry.

Such disclosure contained in patents shows that the known stiffness flex values are arbitrary and vary per manufacturer at various times which has adversely affected the ability of anyone to select a proper shaft for any golfer/player. Not until my invention is this now possible.

With my invention process/methods, electronically measuring, by testing and recording and storing, the flex choices (flex or kickpoints—PDGs) and other shaft characteristics, in a defined and predetermined manner, of steel and/or composite shafts, as directly responsive to a tested individuals swing, characteristics during testing, promotes the electronic selection of the proper golf shaft for that particular individual.

I have discovered through extensive testing of many golfers of varying skill, levels of play, and particularly with respect to composite golf shafts, that flex choices or PDGs directly affect the electronic test results when the golfers are tested with golf shafts having different flex choices or flex points and the same or similar stiffness values. Only by testing electronically can this be accomplished and provide the data necessary for the selection of the proper shaft for a player, which selection is also accomplished electronically.

As stated herein, I have found that my extensive testing of golfers appears to indicate and verify that shaft stiffness becomes secondary to shaft flex point or flex choice during the testing, most possibly because of the varying degrees of stiffness inconsistencies that exist in composite golf shafts made by the same manufacturer and by different shaft manufacturers. Such stiffness inconsistencies exist along with torque inconsistencies, which greatly affects the shaft selection/club fitting process. Thus, this exemplifies the importance of electronically testing various shafts, in accordance with my inventive methods, to select/choose the best proper shaft available on the market, for a player to improve playability/performance.

Furthermore, I have found that torque in relationship to speed with a stiffer shaft will not normally be affected by different PDGs or flex choices during testing. This discovery is still being examined and studied.

The Examples provided on pages 16, 17 and 18 hereinafter are included to illustrate the significant differences in testing results for different shafts, even at low clubhead speeds of 50 mph and below.

Through electronic testing and my invention methods, regardless of the type of shafts being tested, the flex choices or PDGs are significant, and a priority selection factor, when testing in proper clubhead speed ranges. Shafts that are too stiff for a tested golfer will test relatively the same, regardless of flex choice in many instances. But, flex choice is a major determinative factor in a golf shaft that is a proper and best available shaft for a golfer/player.

Also, the flex choice selection, criteria/factor appears to be more applicable to composite shafts than to steel shafts, since it appears that the stiffness consistency of steel shafts far exceeds the inconsistencies of stiffness values that exist in composite shafts.

My inventive process, "Precise Fit Golf Club Fitting System and Golf Shaft Selection Method and Apparatus", which is included herein by reference, makes it possible to determine the flex (PDG) value of choice and stiffness (flex) value through testing and data electronically obtained to correctly fit the individual golfer. My process of being able to correctly fit the individual golfer by selecting the proper shaft electronically now makes the deflection, torque values, and overall performance of the shaft being tested meaningful, regardless of the well known previously existing shafts being compared. Golfers now can be tested and, treated on an individual basis in relationship to shafts, and previous concepts of assigned stiffness values must therefore be deemed inaccurate. Data compiled from testing of golfers, based on my inventive process, reinforces the selection factors of angles/degrees as close to zero, open or closed at impact, speed, angle at impact and swing path, in proper sequence insures success, and determines the priority of flex choice selection, with stiffness value being secondary thereto during testing.

My inventive patent pending process through documented discovery now allows clubhead speeds of golfers under 49-mph to be tracked, and a different set of circumstances can be concluded than previously thought. I have observed that when testing between steel shafts and composite/graphite shafts in the same designated stiffness, differences of tested results can occur. Reliable recorded test speeds tend to record similarly when testing steel shafts at speeds under 50-mph. But, such may not be the case with composite/graphite shafts. With the makeup of composite/graphite shafts and their overall lightness, these differences between steel and composite/graphite shafts may offer other options. Reliable speeds of an individual golfer below 50-mph can be benefitted by and from my inventive process. I have concluded that golfers/players who rely on their hands and arms to generate reliable club head speeds in most instances can generate higher speeds than the golfer/player that uses the larger muscles of their body where lower reliable speeds are present. Speed ranges for testing therefore, should begin below 50-mph and the swing analyzer should have the capacity to record speeds and/or reliable swing speeds as is needed for current or future testing.

Depending on an individual particular swing characteristics, torque, as it is constructed into the shaft, can be of positive benefit to a golfer. Torque is defined as the twisting or rotating of the shaft during/the swing, and particularly the downswing. I have discovered with my inventive process that like shafts from the same manufacturer, with the same stiffness but different torques, can have an impact on angle/degrees, speed, angle at impact and swing path. It has been common practice to position their products in the marketplace more advantageously and composite shafts appear on the market with varying degrees of torque. In the past they have advertised torque values, to my knowledge, from 1½ degrees to as much as 7.5 degrees. I have also found that torque can vary from manufacturer to manufacturer, in the way it responds while testing the individual golfer. It is important to note, no one shaft is right for a majority of golfers as is now touted by the industry. In fact, nothing could be farther from the truth.

One could simply add or subtract weight from the clubhead as desired by design and the stiffness of the shaft would automatically change. For instance, if the clubhead on the shaft designated R stiffness and weighted D-0, by adding weight the shaft would swing more flexible; and by subtracting weight from D-0, the flexibility of the shaft would be depleted, thus a stiffer shaft. Thus, stiffness of shafts as marketed by the manufacturers in swing weight terms are relative and have no commonly accepted absolute definition.

Numerical information gathered on the data sheet below reveals critical numbers that translate into usable data to interpret the characteristics of a golfer/player while striking the golf ball. The data sheet and interpretations of the information recorded tell a story.

The selection format of angle/degrees, open or closed at impact, speed, and swing path, is the primary consideration. Through my inventive process, with the ability to track individuals, specifically there is now evidence to support exceptions. Because of the complexities and differences that currently exist in each and every golfer/player during the loading and unloading of the golf shaft during the swing, each one must be judged separately. The following data sheet of numerical information gathered makes this possible to track. Because of the complexities involved with each individual swing, it is important to note that there are exceptions. The following example demonstrates the importance of my inventive process in such instances.

EXAMPLE

Irene Rubin, age 67, handicap 38, Current clubs, Lynx Tigress-steel shafts

Special Needs: Had surgery to repair torn rotator cup on right shoulder and is fully recovered.

Recommendation: A composite shaft to absorb some of the shock. Testing begins with her present set consisting of steel shafts.

| Type | Speeds | Angles/degrees at Impact | Open or closed at Impact | Swing Path at Impact |
|---|---|---|---|---|
| Lynx Tigress | 39 | 3 | Closed | Outside in |
| Steel shafts | 34 | 0 | Square | Straight |
| Unknown flex | 36 | 2 | Closed | Straight |

With her reliable club head speeds recorded, it should be noted, some manufacturers are reluctant to supply specific characteristics of their shaft products. We continue testing:

| Type | Speeds | Angles/degrees at Impact | Open or closed at Impact | Swing Path at Impact |
|---|---|---|---|---|
| Phoenix | 38 | 4 | Open | Outside in |
| lightweight steel | 38 | 1 | Closed | Outside in |
| L flex | 34 | 1 | Closed | Straight |

The speeds are confirmed and reliable and we continue the testing with composite shafts, designated L flex for stiffness. All shafts tested below are designated and marked L flex for stiffness. According to the manufacturers different examples of torque and playing characteristics are present in each individual shaft. Different torque values are defined when information was available from the manufacturer. It should be noted some manufacturers are reluctant to supply specific characteristics of their product. We continue the testing:

| Type | Speeds | Angles/degrees at Impact | Open or closed at Impact | Swing Path at Impact |
|---|---|---|---|---|
| Graman Super | 47 | 3 | Open | Straight |
| Flex 310 | 41 | 1 | Closed | Straight |
| Composite | 40 | 14 | Open | Straight |
| Graphite A/L flex | 38 | 2 | Open | Straight |

Graman touts this shaft as, "One of our most popular graphite shafts. It is a lightweight, low torque shaft at a very reasonable price. It has high performance characteristics that provide the average to above average player with consistency and accuracy". Specifications-gram weight 78 g. Torque-4.0 degrees.

The numerical information in the example above by my inventive process reveals the following:

The speeds have increased considerably and at first glance this would be an excellent choice. The angles/degrees tell a different story. Three of the four results fall within an acceptable range and except for the occasional errant shot would perform very well. We can make a determination based on three swings if desired. Open or closed at impact and the swing path are acceptable. We continue testing:

| Type | Speeds | Angles/degrees at Impact | Open or closed at Impact | Swing Path at Impact |
|---|---|---|---|---|
| Graman HL-40 | 37 | 18 | Open | Straight |
| Composite 3.5 | 36 | 0 | Square | Straight |
| Graphite L flex | 38 | 0 | Square | Straight |

Graman claims in their advertising, "These super-lightweight, high modulus graphite shafts are manufactured by a proprietary process called "Perfect Geometry". The Ultra Light 40 is designed for low handicaps who demand accelerated clubhead speed and control". Specifications include Gram weight 59 g, length 40", torque 3.5 degrees. L flex The numerical information would indicate this L flex stiffness is slightly different than the example above. If the claims of the manufacturer are valid then the overall speeds can change. The torque is 3.5 degrees as opposed to 4.0 above. The speeds have dropped considerably, and the 18 degrees at angles/degrees makes this shaft unsuitable. It should be noted however, in some instances the difference in torque or degree of torque can affect the overall readings as evident in this example. We continue testing:

| Type | Speeds | Angles/degrees at Impact | Open or closed at Impact | Swing Path at Impact |
|---|---|---|---|---|
| Paragon | 34 | 5 | Closed | Outside in |
| Low Torque 4.0 | 35 | 5 | Open | Straight |
| Graphite L flex | 34 | 5 | Open | Straight |

Paragon touts the Paragon Low Torque as, "Made from 100% graphite with a low-to-mid point for more feel at swing speeds below 90 mph, Low Torque II (two tone) offers the same playability, but with two-tone cosmetics". Specifications include Gram Weight—71 g, Length 39", Torque 3.5 degrees. One could conclude if the shaft with a torque value of 4.0 registered reliable speeds of mid to high 30 mph range in the L flex stiffness, the shaft with a torque value of 3.5 if standards existed in the industry register in the upper 30 mph range and lower 40 mph range in the L flex stiffness if current assessment prevails. Through my inventive process, "Precise Fit Golf Club Fitting System and Golf Shaft Selection Method and Apparatus", with the numeral process now available that there are currently no parameters in the golf industry regarding shafts to draw a conclusion. Only by using my inventive method can golf shafts be fitted to an individual golfer/player for success. We continue testing:

| Type | Speeds | Angles/degrees at Impact | Open or closed at Impact | Swing Path at Impact |
|---|---|---|---|---|
| ML-55 OEM | 50 | 0 | Square | Inside out |
| Composite | 47 | 3 | Open | Inside out |
| graphite | 47 | 8 | Open | Straight |
| L flex | 50 | 3 | Open | Straight |

By testing various composite/graphite shafts and recording reliable speeds in L flex (stiffness), we arrive at the conclusion to fit this individual. This is the shaft of choice, as selected by my invention.

Without shaft standards that have a history of consistency as exists in steel, my inventive process clearly demonstrates the differences in composite/graphic or other exotic materials. I have concluded there are no bad shafts, just wrong shafts. It has been further estimated that the minimum amount of golfers/players using the wrong shafts number no less than 8 out of 10. Based on my records with my inventive process I conclude individuals/golfers/players incidents of wrong shafts in their current set is much higher statistically.

It also should be noted here that the category "Special Needs" is of prime importance when fitting a special needs golfer/player properly. The above example is an actual customer case.

Additional Exhibits of testing results follow, and these Exhibits are mentioned on page 4 of this application.

EXHIBIT ONE
IRONS

| Type Irons | Speeds | Angles/ degrees at Impact | Open or closed at Impact | Swing Path at Impact |
|---|---|---|---|---|
| Customer Clubs | Not available | 2 | Open | Straight |
| Std 600 | 72 | 1 | Open | Straight |
| R Flex | 68 | 8 | Open | Straight |
| Steel | 70 | 1 | Open | Straight |
| Phoenix 560 | 66 | 1 | Open | Straight |
| L Flex | 70 | 2 | Open | Straight |
| Composite | 69 | 1 | Open | Straight |
| Graphite | 70 | 1 | Open | Straight |
| PP 560 | 69 | 0 | Square | Straight |
| F Flex | 72 | 2 | Open | Straight |
| Composite | 70 | 1 | Open | Straight |
| Graphite | 70 | 1 | Open | Straight |
| Mt 560 | 73 | 2 | Open | Straight |
| L Flex | 72 | 2 | Open | Straight |
| Composite | 74 | 3 | Open | Straight |
| Graphite | 74 | 1 | Open | Straight |
| Std 560 | 70 | 2 | Open | Straight |
| L Flex | 72 | 2 | Open | Straight |
| Composite | 69 | 1 | Open | Straight |
| Graphite | 70 | 1 | Open | Straight |
| HL40 | 77 | 1 | Open | Straight |
| L Flex 3.5 | 81 | 1 | Open | Straight |
| Composite | 80 | 1 | Open | Straight |
| Graphite | 78 | 1 | Open | Straight |
| GW560 | 73 | 3 | Open | Straight |
| A Flex | 73 | 1 | Open | Straight |
| Composite | 77 | 9 | Open | Straight |
| Graphite | 73 | 1 | Open | Straight |
| Graman L Flex | 72 | 2 | Open | Straight |
| Composite | 71 | 7 | Open | Straight |
| Graphite | 72 | 1 | Open | Straight |
| HL40 R Flex 3.5 | 70 | 2 | Open | Straight |
| Composite | 66 | 1 | Open | Straight |
| Graphite (to confirm) | 68 | 1 | Open | Straight |
| Strategy L Flex | 70 | 8 | Open | Straight |
| Composite | 70 | 2 | Open | Straight |
| Graphite | 70 | 8 | Open | Straight |

EXHIBIT TWO

| Type Irons | Speeds | Angles/degrees at Impact | Open or closed at Impact | Swing Path at Impact |
|---|---|---|---|---|
| Callaway L Flex | 41 | 6 | Closed | Straight |
| Woods | 40 | 10 | Closed | Straight |
| Composite | 39 | 4 | Closed | Straight |
| Graphite | 42 | 7 | Closed | Straight |
| GW560 L Flex | 34 | 2 | Closed | Straight |
| Composite | 37 | 13 | Closed | Outside In |
| Graphite | 34 | 10 | Closed | Outside In |
| | 37 | 13 | Closed | Outside In |
| Graman Green | 39 | 27 | Closed | Outside In |
| L Flex | 34 | 3 | Open | Straight |
| Composite | 36 | 10 | Open | Straight |
| Graphite | 36 | 9 | Open | Outside In |
| Lynx | 39 | 3 | Closed | Outside In |
| Flex Unknown | 34 | 0 | Square | Straight |
| Steel | 36 | 2 | Closed | Straight |
| Phx 560 L Flex | 38 | 4 | Open | Outside In |
| Steel | 38 | 1 | Closed | Outside In |
| | 34 | 1 | Closed | Straight |
| Graman L Flex | 47 | 3 | Open | Straight |
| Composite | 41 | 1 | Closed | Straight |
| Graphite | 40 | 14 | Open | Straight |
| | 38 | 2 | Open | Straight |

-continued

EXHIBIT TWO

| Type Irons | Speeds | Angles/degrees at Impact | Open or closed at Impact | Swing Path at Impact |
|---|---|---|---|---|
| HL40 L Flex | 37 | 18 | Open | Straight |
| Composite | 36 | 0 | Square | Straight |
| Graphite | 38 | 0 | Square | Straight |
| Lite L Flex | 38 | 23 | Open | Straight |
| Composite | 49 | 9 | Closed | Straight |
| Graphite | 37 | 12 | Open | Straight |
| Paragon L Flex | 34 | 5 | Closed | Outside In |
| Composite | 35 | 5 | Open | Straight |
| Graphite | 34 | 5 | Open | Straight |
| Strategy L Flex | 31 | 1 | Closed | Straight |
| Composite | 32 | 0 | Square | Straight |
| Graphite | 31 | 0 | Square | Straight |
| ML55 L Flex | 50 | 0 | Square | Inside Out |
| Composite | 47 | 3 | Open | Inside Out |
| Graphite | 47 | 8 | Open | Straight |
| | 50 | 3 | Open | Straight |

EXHIBIT THREE
WOODS

| Type Irons | Speeds | Angles/degrees at Impact | Open or closed at Impact | Swing Path at Impact |
|---|---|---|---|---|
| Aldila | 78 | 29 | Closed | Straight |
| S Flex | 79 | 9 | Closed | Straight |
| Composite | 79 | 1 | Closed | Straight |
| Graphite | 80 | 1 | Open | Straight |
| HL40 | 78 | 2 | Open | Straight |
| L Flex | 80 | 3 | Open | Straight |
| Composite | 85 | 3 | Open | Straight |
| Graphite | 86 | 3 | Open | Straight |
| Graman | 86 | 3 | Open | Straight |
| A Flex | 84 | 25 | Closed | Outside In |
| Composite | 86 | 10 | Closed | Straight |
| Graphite | 86 | 13 | Closed | Straight |
| HL40 | 88 | 2 | Open | Straight |
| R Flex | 88 | 3 | Closed | Straight |
| Composite | 89 | 2 | Open | Straight |
| Graphite | 88 | 2 | Open | Straight |
| Paragon L Flex | 85 | 12 | Closed | Straight |
| Composite | 89 | 4 | Open | Straight |
| Graphite | 96 | 21 | Open | Straight |
| Paragon R Flex | 89 | 3 | Open | Straight |
| Composite | 82 | 11 | Open | Straight |
| Graphite | 85 | 12 | Open | Outside In |
| Graman R Flex | 92 | 10 | Open | Straight |
| Composite | 91 | 3 | Open | Straight |
| Graphite | 92 | 10 | Open | Straight |
| Graman A Flex | 80 | 2 | Closed | Straight |
| Composite | 85 | 2 | Open | Straight |
| Graphite | 81 | 2 | Open | Straight |
| | 80 | 2 | Open | Straight |
| GLT L Flex | 84 | 2 | Closed | Straight |
| Composite | 82 | 2 | Open | Straight |
| Graphite | 78 | 1 | Open | Straight |

Another aspect and application of my electronic club fitting and shaft selection invention pertains to the "cutting instructions" for building the golf club(s) after the proper shaft with particular stiffness and flex choice values has been electronically selected. With respect to "cutting instructions", due to the construction of most steel shafts having fairly consistent stiffness values, and the inconsistent stiffness values of many composite shafts, and the affixation of the flex points in particular shafts, the cutting of the shaft can be made to change to some degree the stiffness of the selected shaft when built into a golf club. Slightly more cut can make the shaft stiffer and slightly less cut can make the shaft more flexible. My electronically programmed method, and analysis program, can discern these differences and adjustments can be made to afford even closer/tighter tolerances to allow the built club to test and perform even closer to zero degrees at impact. And, after the club(s) is built with the shaft(s) that were selected electronically, that club(s) can and may be tested to insure that the built club tests comparatively with the test results chosen to select the shaft to thus further,verify the process and provide to the golfers/players/customer the proper shaft for his/her individual swing characteristics.

Thus, it is apparent that there has been provided, in accordance with the disclosed invention methods, additional methods of electronic selection of a proper golf shaft for variou's players/individuals of varying skill levels. While the invention methods have been described in conjunction with specific embodiments/applications thereof, it is evident that many alternatives, modifications and variations will be apparent to those of ordinary skill in the art, in light of the foregoing disclosure. Accordingly, it is intended to embrace all such alternatives, modifications and variations that fall within the spirit and scope of the appended claims.

What is claimed is:

1. A computer software controlled method of fitting a golf shaft to a golfer to allow said golfer to have the ability to process accuracy and consistency in his or her golf swing/shot performance comprising the steps of electronically determining the selection of said golf shaft by electronically testing, recording and storing said golfers reliable club head swings speeds values and angle/degrees, at impact, values of golf club shafts having different flex choice and stiffness values, and electronically selecting the golf shaft with particular stiffness and flex choice values on the basis of said reliable club head speeds, and said angle/degrees at impact, values to allow the said golfer the ability to perform accurate and consistent golf swings/shots, including prioritizing said testing and said selection by firstly testing on the basis of flex choice, and secondly testing on the basis of stiffness value for composite golf shafts in view of the variance of stiffness and torque values that exist in said composite shafts.

2. A method as defined in claim 1, further comprising the step of determining said selection separately for woods and irons for said golfer.

3. A method as defined in claims 1 or 2, further including the steps of constructing a golf club in accordance with the electronically selected shaft having selected flex choice and stiffness values, and testing the constructed golf club to insure and verify if it tests comparatively with the test results parameters/criteria that were electronically determined and selected for the said golfer.

4. A method as defined in claim 1, further including the step of utilizing said methods for testing a golf shaft having particular stiffness and torque values identified by its manufacturer to provide its electronically generated test results and thereafter testing other golf shafts having an identical said particular stiffness and torque values as identified by the same manufacturer or another manufacturer, to obtain test results, and comparing such test results to confirm whether or not said golf shafts bear accurate identification of said particular stiffness and torque values.

* * * * *